US009519258B1

(12) United States Patent
Akamatsu

(10) Patent No.: US 9,519,258 B1
(45) Date of Patent: Dec. 13, 2016

(54) IMAGE FORMING UNIT, IMAGE FORMING APPARATUS, AND CLEANING DEVICE

(71) Applicant: FUJI XEROX CO., LTD., Tokyo (JP)

(72) Inventor: Hiroaki Akamatsu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/994,669

(22) Filed: Jan. 13, 2016

(30) Foreign Application Priority Data

Aug. 26, 2015 (JP) ..... 2015-167064

(51) Int. Cl.
*G03G 21/00* (2006.01)

(52) U.S. Cl.
CPC ..... *G03G 21/0017* (2013.01)

(58) Field of Classification Search
CPC ..... G03G 21/0005; G03G 21/0011; G03G 21/0094; G03G 15/161
USPC ..... 399/101, 346, 350, 351
See application file for complete search history.

(56) References Cited

U.S. PATENT DOCUMENTS 5,463,456 A * 10/1995 Yashiki et al. ..... G03G 21/0005 399/350
8,034,525 B2 * 10/2011 Matsumoto et al. .. G03G 5/005 430/119.7
8,364,069 B2 * 1/2013 Arai et al. ..... G03G 21/0094 399/346
9,170,557 B2 * 10/2015 Watanabe et al. . G03G 21/0017

FOREIGN PATENT DOCUMENTS

JP 2010-217593 A 9/2010
JP 2011-197397 A 10/2011
JP 2014-170118 A 9/2014

* cited by examiner

*Primary Examiner* — William J Royer
(74) *Attorney, Agent, or Firm* — Oliff PLC

(57) ABSTRACT

An image forming unit includes an image carrying body, a plate-shaped cleaning member, and a powder of a fatty acid metal salt. The image carrying body is configured to be rotatable and carries an image formed on a surface thereof with a toner. The plate-shaped cleaning member includes a tip portion which is pressed against the surface and which scrapes a material adhering onto the surface in response to rotation of the image carrying body. The powder of the fatty acid metal salt is applied to at least one of the tip portion and the surface.

12 Claims, 4 Drawing Sheets

FIG. 6

| CONTENT OF ZnSt IN DEVELOPER: 0% BY WEIGHT | | | |
|---|---|---|---|
| EVALUATION ITEMS | ZnSt IS NOT APPLIED (PMMA IS APPLIED) | APPLIED TO CLEANING MEMBER (CONFIGURATION EXAMPLE 1) | APPLIED TO PHOTORECEPTOR BODY (CONFIGURATION EXAMPLE 2) |
| INITIAL CLEANING PERFORMANCE | × | ○ | ○ |
| AGING CLEANING PERFORMANCE | ○ | ○ | ○ |
| BCR POLLUTION | ○ | ○ | ○ |
| IMAGE STRIPES | ○ | ○ | ○ |

| CONTENT OF ZnSt IN DEVELOPER: 0.05% BY WEIGHT | | | |
|---|---|---|---|
| EVALUATION ITEMS | ZnSt IS NOT APPLIED (PMMA IS APPLIED) | APPLIED TO CLEANING MEMBER (CONFIGURATION EXAMPLE 1) | APPLIED TO PHOTORECEPTOR BODY (CONFIGURATION EXAMPLE 2) |
| INITIAL CLEANING PERFORMANCE | × | ○ | ○ |
| AGING CLEANING PERFORMANCE | ○ | ○ | ○ |
| BCR POLLUTION | ○ | ○ | ○ |
| IMAGE STRIPES | ○ | ○ | ○ |

| CONTENT OF ZnSt IN DEVELOPER: 0.20% BY WEIGHT | | | |
|---|---|---|---|
| EVALUATION ITEMS | ZnSt IS NOT APPLIED (PMMA IS APPLIED) | APPLIED TO CLEANING MEMBER (CONFIGURATION EXAMPLE 1) | APPLIED TO PHOTORECEPTOR BODY (CONFIGURATION EXAMPLE 2) |
| INITIAL CLEANING PERFORMANCE | ○ | ○ | ○ |
| AGING CLEANING PERFORMANCE | × | × | × |
| BCR POLLUTION | × | × | × |
| IMAGE STRIPES | × | × | × |

IMAGE FORMING UNIT, IMAGE FORMING APPARATUS, AND CLEANING DEVICE

CROSS-REFERENCE TO RELATED APPLICATIONS

This application is based on and claims priority under 35 USC 119 from Japanese Patent Application No. 2015-167064 filed on Aug. 26, 2015.

BACKGROUND

Technical Field

The present invention relates to an image forming unit, an image forming apparatus, and a cleaning device.

SUMMARY

According to an aspect of the invention, an image forming unit includes an image carrying body, a plate-shaped cleaning member, and a powder of a fatty acid metal salt. The image carrying body is configured to be rotatable and carries an image formed on a surface thereof with a toner. The plate-shaped cleaning member includes a tip portion which is pressed against the surface and which scrapes a material adhering onto the surface in response to rotation of the image carrying body. The powder of the fatty acid metal salt is applied to at least one of the tip portion and the surface.

BRIEF DESCRIPTION OF THE DRAWINGS

Exemplary embodiment(s) of the present invention will be described in detail based on the following figures, wherein:

FIG. 6 is a diagram illustrating evaluation results of cleaning performance of the cleaning member according to the exemplary embodiment.

DETAILED DESCRIPTION

Figure 1:
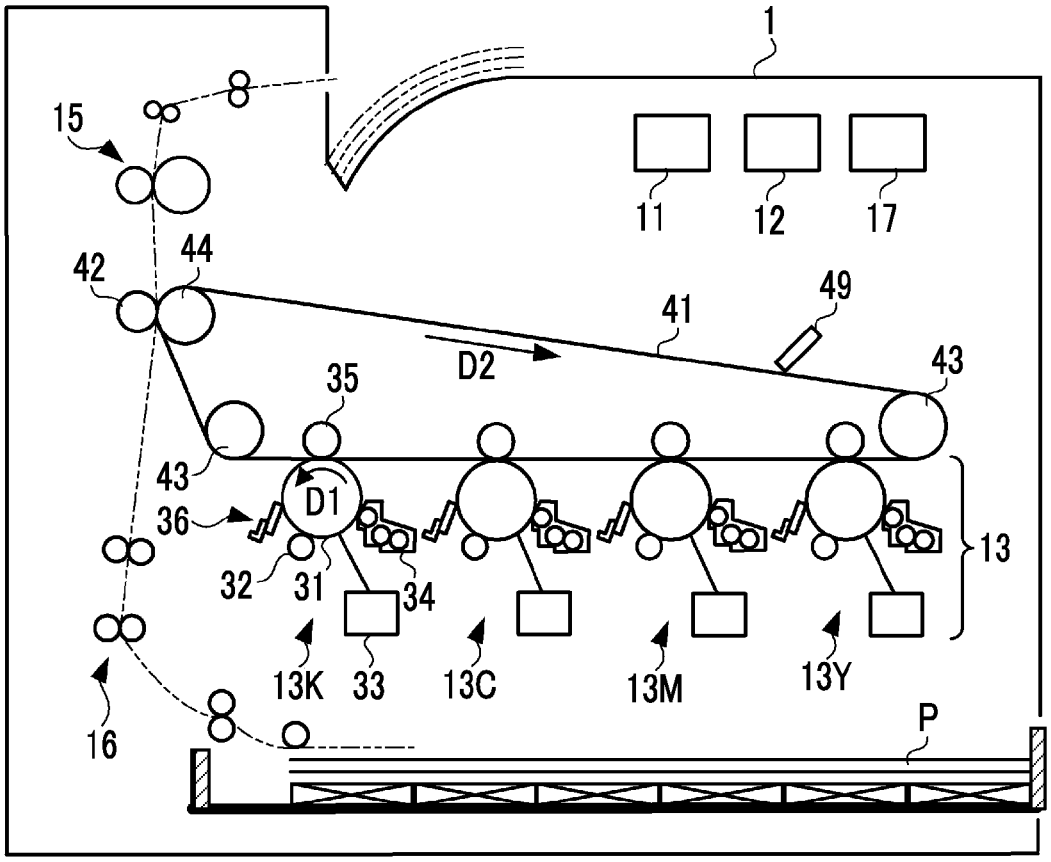
FIG. 1 is a diagram illustrating the entire configuration of an image forming apparatus according to one exemplary embodiment of the invention.

FIG. 1 is a diagram illustrating an entire configuration of an image forming apparatus according to an exemplary embodiment of the invention. An image forming apparatus 1 illustrated in FIG. 1 is, here, a tandem type and forms an image on a sheet P by an electrophotographic process. A control section 11 includes a process having a Central Processing Unit (CPU), a Read Only Memory (ROM), and a Random Access Memory (RAM). The CPU controls each section of the image forming apparatus 1 by reading and executing programs stored in the ROM or a storage section 12. The storage section 12 includes, for example, a hard disk and stores programs or other data to be executed by the control section 11. An operation section 17 includes, for example, operation buttons and accepts operations performed by an operator.

Toner image forming sections 13Y, 13M, 13C, and 13K form an image (hereinafter, referred to as a "toner image") on a surface of an intermediate transfer body 41 with a toner. "Y", "M", "C", and "K" that are attached to ends of symbols of elements to be described below respectively means elements corresponding to toner of yellow, magenta, cyan, and black. Each of the toner image forming sections 13Y, 13M, 13C, and 13K has the same configuration except that colors of handling toner are different from each other. In the following description, the toner image forming sections 13Y, 13M, 13C, and 13K will be collectively referred to as "toner image forming section 13" when it is not needed to particularly distinguish each of the toner image forming sections 13Y, 13M, 13C, and 13K.

Moreover, the toner image forming section 13 is an example of an image forming unit of the exemplary embodiment of the invention and is a unit type device (also referred to as a process cartridge) that is detachably configured in the image forming apparatus 1. However, the toner image forming section 13 may be a device incorporated in the image forming apparatus 1.

The toner image forming section 13 includes a photoreceptor body 31, a charging device 32, an exposure device 33, a developing device 34, a first transfer roll 35, and a cleaning device 36.

The photoreceptor body 31 is an example of an image carrying body of the exemplary embodiment of the invention and is a photoreceptor body drum that is cylindrically formed. The photoreceptor body 31 holds the toner image formed on the surface. The photoreceptor body 31 is rotatably configured about a center shaft as a rotation shaft. Specifically, the rotation shaft of the photoreceptor body 31 is connected to a driving section (not illustrated) and the photoreceptor body 31 is rotated in a direction of arrow D1 in FIG. 1 (in this case, the counterclockwise direction).

The charging device 32 is an example of a charging unit of the exemplary embodiment of the invention and includes a charging roll that contacts with a surface of the photoreceptor body 31 and charges the surface of the photoreceptor body 31 in a predetermined potential. The exposure device 33 is an example of a latent image forming unit of the exemplary embodiment of the invention and includes, for example, a laser beam emitting source and a polygon mirror. In the exposure device 33, the photoreceptor body 31 is irradiated with a laser beam in compliance with image data supplied from, for example, an external device, after the photoreceptor body 31 is charged by the charging device 32. The latent image is formed on the surface of the photoreceptor body 31 by illumination of the laser beam.

The developing device 34 is an example of a developing unit of the exemplary embodiment of the invention. The developing device 34 accommodates toner of any one color of Y, M, C, and K, and developer containing an external additive such as silica. Each of the toner and the external additive is powder. The developing device 34 supplies toner to the latent image formed on a surface of the photoreceptor body 31 and develops the latent image to a toner image.

Moreover, in the exemplary embodiment, unless otherwise noted, the developer accommodated in the developing device 34 does not contain lubricant (for example, lubricant containing fatty acid metal salt) for protecting the surface of the photoreceptor body 31.

The first transfer roll 35 is an example of a transfer unit of the exemplary embodiment of the invention and transfers the toner image formed on the surface of the photoreceptor body 31 to the intermediate transfer body 41 by generating a predetermined potential difference in a position the intermediate transfer body 41 faces the photoreceptor body 31.

The cleaning device 36 is an example of a cleaning device of the exemplary embodiment of the invention and is a device for cleaning the surface of the photoreceptor body 31 after the toner image is transferred. Specifically, the cleaning device 36 scrapes a material adhering onto the surface of the photoreceptor body 31. The adhering material is mainly remaining toner, but includes the external additive contained in the developer.

The intermediate transfer body 41 is an endless belt member and is stretched by belt transport rolls 43 and a backup roll 44. Each of the belt transport rolls 43 and the backup roll 44 is a rotation shaft for causing the intermediate transfer body 41 to revolve and at least one of the belt transport rolls 43 and the backup roll 44 is rotated by a driving section (not illustrated). The intermediate transfer body 41 revolves in arrow D2 direction (here, clockwise) in FIG. 1. The belt transport roll 43 or the backup roll 44 that does not have the driving section is rotated in response to the rotation of the intermediate transfer body 41. The intermediate transfer body 41 revolves and then the toner image on the intermediate transfer body 41 is moved to a nip region that is formed by being interposed between a secondary transfer roll 42 and the backup roll 44.

A transport device 16 has a container and a transport roll. Sheets P that are cut in a size that is set in advance are accommodated in the container. The transport device 16 moves the sheets P that are taken out from the container by the transport roll one by one to the nip region between the secondary transfer roll 42 and the backup roll 44.

Moreover, the sheet P may be replaced by a sheet-shaped medium formed by a material other than paper, for example, a sheet made of resin.

The secondary transfer roll 42 transfers the toner image on the intermediate transfer body 41 that is moved to the nip region to the sheet P transported from the transport device 16 by the potential difference with the intermediate transfer body 41. A belt cleaner 49 cleans a surface of the intermediate transfer body 41 after the toner image is transferred by the secondary transfer roll 42. The transport device 16 transports the sheet P to which the toner image is transferred to a fixing device 15.

The fixing device 15 fixes the toner image, which is transferred to the sheet P, to the sheet P that is heated. The transport device 16 causes the sheet P on which the toner image is fixed by the fixing device 15 to exit to the image forming apparatus 1.

Under the above-described configuration, the toner image forming section 13 includes fatty acid metal salt powder to improve initial cleaning performance of a cleaning member (cleaning member 362 described below) included in the cleaning device 36 and to stabilize the aging cleaning performance. As a configuration example of the toner image forming section 13, there are the following (Configuration Example 1) and (Configuration Example 2).

Configuration Example 1

Figure 2:
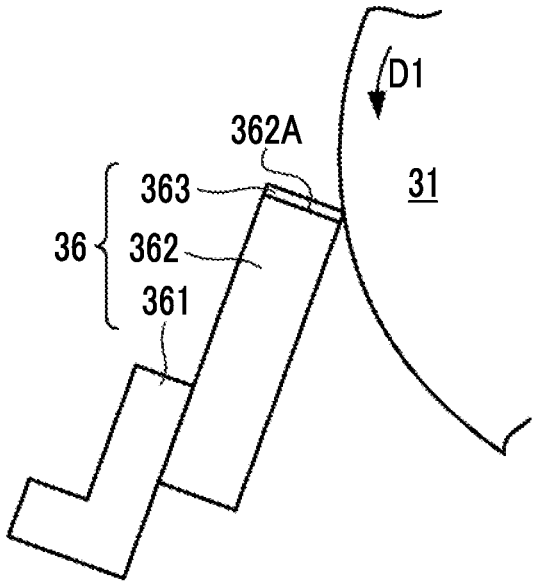
FIG. 2 is a diagram illustrating the configuration of a cleaning device and a photoreceptor body of Configuration Example 1 according to the exemplary embodiment.

FIG. 2 is a diagram illustrating a configuration of the cleaning device 36 and the photoreceptor body 31 of Configuration Example 1. A diagram, in which the cleaning device 36 is viewed in a plan diagram in the axial direction of the rotation shaft of the photoreceptor body 31, is illustrated in FIG. 2.

The cleaning device 36 includes a support member 361, the cleaning member 362, and fatty acid metal salt powder 363. The support member 361 is a member for supporting the cleaning member 362. The support member 361 is fixed to a housing (not illustrated) of the image forming apparatus 1. The cleaning member 362 is a so-called cleaning blade and is a member that is formed in a plate shape made of a deformable material such as rubber. One end of the cleaning member 362 in a longitudinal direction is supported by the support member 361. A part of an end surface 362A of the cleaning member 362 on the other side in the longitudinal direction, more specifically, a region including a corner is pressed against the surface of the photoreceptor body 31. The cleaning member 362 scrapes the material adhering onto the surface of the photoreceptor body 31 in response to the rotation of the photoreceptor body 31.

Here, the fatty acid metal salt powder 363 is zinc stearate (ZnSt). The fatty acid metal salt powder 363 is applied from one end to other end of the end surface 362A in the axial direction of the rotation shaft of the photoreceptor body 31. The fatty acid metal salt powder 363 is, for example, applied to an entirety of the end surface 362A. The fatty acid metal salt powder 363 is applied in a step (for example, manufacturing step) before shipping of a product of the toner image forming section 13 or the image forming apparatus 1 by using, for example, a tool such as a paintbrush, a pen, or a brush. That is, the fatty acid metal salt powder 363 is in a state of being applied to the cleaning member 362 when a user starts using of the toner image forming section 13 or the image forming apparatus 1.

In addition, the fatty acid metal salt powder 363 may be applied to a surface (for example, the entirety of the cleaning member 362) in the cleaning member 362 except the end surface 362A.

Incidentally, in a period near start of using of the toner image forming section 13 or the image forming apparatus 1, the cleaning member 362 is in an initial state in which the cleaning member 362 is not deformed or is slightly deformed. Thus, in the related art, the cleaning member 362 is in the initial state, a wedge shaped space, in which the external additive such as toner or silica is sufficiently accommodated, is not formed between the cleaning member 362 and the photoreceptor body 31 and ability of the surface of the photoreceptor body 31 to scrape the adhering material is insufficient.

Furthermore, if the toner image forming section 13 or the image forming apparatus is stored under high temperature and high humidity environment, the corner portion in the tip portion of the cleaning member 362, which is pressed against the photoreceptor body 31, may cause a permanent deformation. Thus, retraction of the tip of the cleaning member 362 is reduced and an adhesion degree with the photoreceptor body 31 is degraded during rotation of the photoreceptor body 31.

For the above-described reasons, the initial cleaning performance of the cleaning member 362 is reduced. Even if frictional resistance between the cleaning member 362 and the photoreceptor body 31 is excessively large, the cleaning performance is lowered for reasons such as the cleaning member 362 is curled up.

Figure 3:
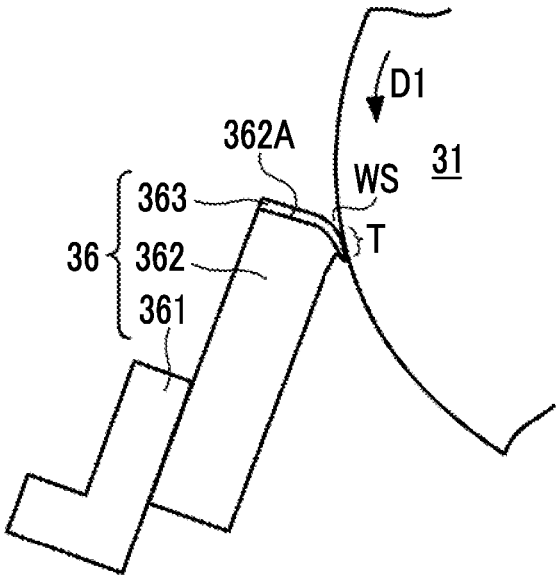
FIG. 3 is an explanatory diagram of deformation of a cleaning member of Configuration Example 1 according to the exemplary embodiment.

Meanwhile, the fatty acid metal salt powder 363 is applied to the end surface 362A of the cleaning member 362 and thus, the initial cleaning performance of the cleaning member 362 is improved. An operation thereof will be described. As illustrated in FIG. 3, when it is started to use the toner image forming section 13 or the image forming apparatus 1 is started and the photoreceptor body 31 is rotated, the fatty acid metal salt powder 363 is interposed between a tip portion T of the cleaning member 362 and the surface of the photoreceptor body 31. The tip portion T is a portion of the end surface 362A, which contacts with the surface of the photoreceptor body 31. The adhesion degree (adhesion property) between the tip portion T and the surface of the photoreceptor body 31 is improved by interposition of the fatty acid metal salt powder 363. As a result, the cleaning member 362 is easily deformed by being pulled in a tangential direction of the surface of the photoreceptor body 31 and a fine wedge-shaped space WS is rapidly formed between the cleaning member 362 and the surface of the photoreceptor body 31. The space WS is rapidly formed and thereby the initial cleaning performance of the cleaning member 362 is improved.

Moreover, after the space WS described in FIG. 3 is formed, the cleaning member 362 is maintained in a shape illustrated in FIG. 3. Thus, after the cleaning member 362 is deformed, some or entirety of the fatty acid metal salt powder 363 may be separated from the end surface 362A. In addition, the fatty acid metal salt powder 363 may not be necessarily applied to the entirety of the end surface 362A and may be applied to at least the tip portion T.

Configuration Example 2

According to the operation described in (Configuration Example 1), if fatty acid metal salt powder is interposed between the tip portion T and the surface of the photoreceptor body 31, the initial cleaning performance of the cleaning member 362 is improved. Thus, fatty acid metal salt powder is not applied to the cleaning member 362 but may be applied to the surface of the photoreceptor body 31.

Figure 4:
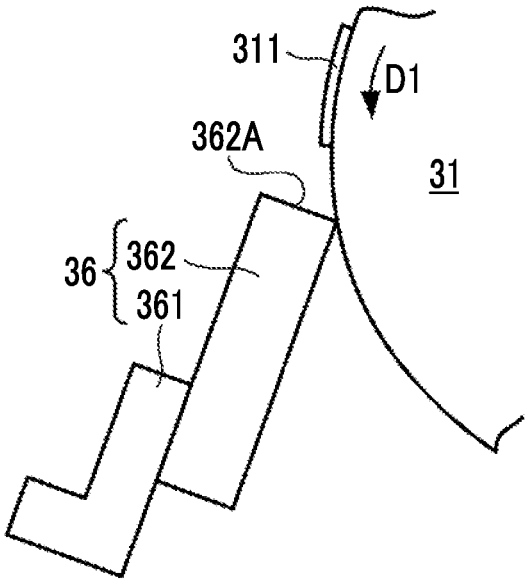
FIG. 4 is a diagram illustrating the configurations of a cleaning device and a photoreceptor body of Configuration Example 2 according to the exemplary embodiment.

FIG. 4 is a diagram illustrating configurations of a cleaning device 36 and a photoreceptor body 31 of Configuration Example 2. A diagram, in which the cleaning device 36 is viewed in a plan view in the axial direction of the rotation shaft of the photoreceptor body 31, is illustrated in FIG. 4.

The cleaning device 36 includes a support member 361 and a cleaning member 362. Configuration Example 2 is the same as that of Configuration Example 1 except that the cleaning device 36 of Configuration Example 2 does not include the fatty acid metal salt powder 363 and the cleaning member 362 contacts with the surface of the photoreceptor body 31.

Fatty acid metal salt 311 is applied to the surface of the photoreceptor body 31. The fatty acid metal salt 311 is applied to a region of at least a part of the photoreceptor body 31 in rotation direction D1. In addition, the fatty acid metal salt 311 is applied from one end to the other end of the surface of the photoreceptor body 31 in the axial direction of the rotation shaft of the photoreceptor body 31. A step of applying the fatty acid metal salt 311 or a method of application is the same as the description of Configuration Example 1.

In addition, the fatty acid metal salt 311 may be applied to any region of the surface of the photoreceptor body 31. However, it is preferable that a position to which the fatty acid metal salt 311 is applied is devised or an operation of the toner image forming section 13 is controlled such that the fatty acid metal salt 311 is interposed between the tip portion T and the surface of the photoreceptor body 31 before toner or the external additive is interposed therebetween.

Moreover, the fatty acid metal salt 311 may be applied to the entire surface of the photoreceptor body 31 in rotation direction D1.

Figure 5:
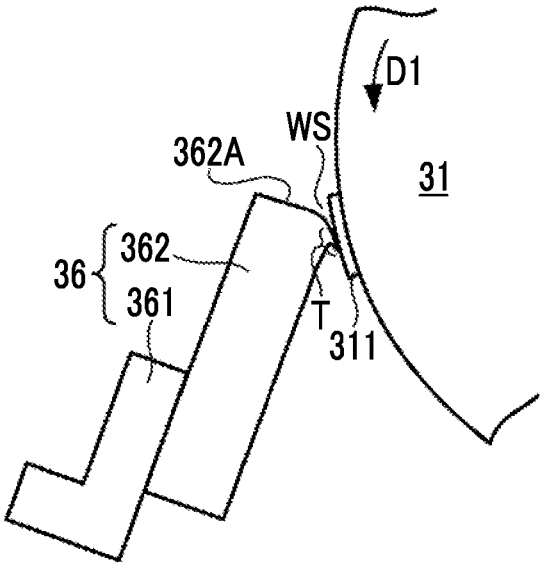
FIG. 5 is an explanatory diagram of deformation of a cleaning member of Configuration Example 2 according to the exemplary embodiment.

If the photoreceptor body 31 is rotated, as illustrated in FIG. 5, the fatty acid metal salt 311 is interposed between the tip portion T and the surface of the photoreceptor body 31. As described above, the fatty acid metal salt 311 is interposed therebetween and then the adhesion degree between the tip portion T and the surface of the photoreceptor body 31 is improved. As a result, the cleaning member 362 is deformed in a tangential direction of the surface of the photoreceptor body 31 and a fine wedge-shaped space WS is formed. As a result, the initial cleaning performance of the cleaning member 362 is improved.

(Evaluations of the Cleaning Performance)

The inventor of the present application confirms that as described in Configuration Example 1 and Configuration Example 2, fatty acid metal salt is applied and then the cleaning performance of the cleaning member 362 is improved, and the aging cleaning performance is stabilized. For this confirmation, the inventor evaluates the cleaning performance of the cleaning member 362 in the following method.

The inventor stores the image forming apparatus 1 under a high temperature and high humidity environment (45 degrees Celsius and humidity 95%) for 72 hours in a state where the cleaning member 362 is pressed against the photoreceptor body 31, and then moves the image forming apparatus 1 to a low temperature and low humidity environment (10 degrees Celsius and humidity 15%). Then, the inventor turns off (that is, the potential difference is zero) a transfer potential of the first transfer roll 35 and forms, on the photoreceptor body 31 with a single color, a toner image having 100% in image density (that is, a solid image) and corresponding to one sheet of paper having A3 size. In this case, since the toner image is not transferred from the photoreceptor body 31 to the intermediate transfer body 41, cleaning is performed by the cleaning device 36 in a state where the toner image is almost remaining on the photoreceptor body 31 as it is. For example, when a jam occurs during printing in the image forming apparatus 1, the toner image may almost remain on the photoreceptor body 31 as it is. Therefore, the inventor evaluates the cleaning performance with the assumption that an amount of toner adhering to the photoreceptor body 31 is great. Furthermore, the inventor evaluates the cleaning performance after 100,000 single-color toner images having 5% in image density are printed with setting the paper size to A4 size and setting the transfer potential of the first transfer roll 15 to normal printing, as aging cleaning performance of the cleaning member 362.

Normally, in order to prohibit blade curling, lubricant powder made of PMMA is applied to the tip portion of the cleaning member, and idling of the photoreceptor body may be performed. An evaluation result of the case where PMMA is applied to the cleaning member as described above is regarded as an evaluation result of "ZnSt is not applied". An "ZnSt is applied to the cleaning member" is regarded as an evaluation result of the case of Configuration Example 1, and "ZnSt is applied to the photoreceptor body" is regarded as an evaluation result of the case of Configuration Example 2.

In addition, the evaluation is made with changing the content of ZnSt in the developer accommodated in the developing device 34 to 0% by weight (that is, ZnSt is not contained in the developer), 0.05% by weight, and 0.20% by weight. The content of ZnSt indicates a percentage of the weight of ZnSt occupied in the weight of toner. In addition, the inventor evaluates a situation of pollution (hereinafter, referred to as "BCR pollution") of the charging roll of the charging device 32 after 100,000 sheets are printed and a degree of occurrence of image stripes in the photoreceptor body 31 after 100,000 sheets are printed and the cleaning is performed, in addition to cleaning performance of the cleaning member 362. The evaluation results are illustrated in FIG. 6.

In FIG. 6, for the cleaning performance of the cleaning member 362, the case where toner slipping does not occur in the photoreceptor body 31 is indicated as "O," and the case where toner slipping occurs in the photoreceptor body 31 is indicated as "x." For the BCR pollution, the case where the image stripes due to BCR do not occur is indicated as "O," and the case where the image stripes occur is indicated as "x". For a degree of occurrence of the image stripes, the case where the image stripes extending in the rotation direction of the photoreceptor body 31 do not occur is indicated as "O," and the case where the image stripes occur is indicated as "x."

As illustrated in FIG. 6, in the case where the PMMA is applied to the end surface 362A, when the content of ZnSt is 0.20% by weight, the initial cleaning performance of the cleaning member 362 is improved. However, the aging cleaning performance, the BCR pollution, and the image stripes are respectively not good, and the cleaning performance is not good. In the case where ZnSt is contained in the developer in a relatively large amount and ZnSt is continuously supplied to the photoreceptor body 31, the amount of ZnSt reaching the charging roll of the charging device 32 is increased. It is considered that presence of ZnSt causes stickiness of the charging roll, the external additive of the developer adheres to the charging roll, and thus the BCR pollution progresses. In the case where the content of ZnSt is 0% by weight or 0.05% by weight, the aging cleaning performance, the BCR pollution, and the image stripes are respectively good, but the initial cleaning performance of the cleaning member is bad.

On the other hand, for the case where ZnSt is applied to the cleaning member 362 and the case where ZnSt is applied to the photoreceptor body 31, the content of ZnSt was 0% by weight or 0.05% by weight, and then the initial cleaning performance of the cleaning member 362 is tested. In addition, the aging cleaning performance, the BCR pollution, and the image stripes are respectively good, and the cleaning performance was stabilized in a state of being improved. In the case where the content of ZnSt is 0.20% by weight, the initial cleaning performance of the cleaning member 362 is improved, but the aging cleaning performance, the BCR pollution, and the image stripes are respectively not good.

As described above, the inventor confirms that the initial cleaning performance of the photoreceptor body 31 is improved and the aging cleaning performance is stabilized by applying ZnSt to the cleaning member 362 or the photoreceptor body 31. In addition, the inventor confirms that the cleaning performance is improved if the content of ZnSt in the developer accommodated in the developing device 34 is equal to or less than a certain amount.

Thus, the image forming apparatus 1 may not use a lubricant supply unit that supplies lubricant (for example, lubricant containing fatty acid metal salt) to the surface of the photoreceptor body 31 for the purpose of improving the initial cleaning performance of the cleaning member 362 and stabilizing the aging cleaning performance. Specifically, the image forming apparatus 1 may not include the lubricant supply unit separately. Also, the image forming apparatus 1 may not have the configuration for mounting the lubricant supply unit thereon.

It should be noted that the fatty acid metal salt is not limited to ZnSt and that the following materials may be used. For example, fatty acid metal salt of straight-chain hydrocarbon such as myristic acid, palmitic acid, sutaerin acid, and alain acid is included. As metal, lithium, magnesium, calcium, strontium, zinc, cadmium, aluminum, cerium, magnesium stearate, aluminum stearate, iron stearate, and the like are preferable, and zinc stearate is especially preferable.

Exemplary embodiments of the invention may be embodied in forms different from the above-described embodiments. In addition, modification examples described below may be respectively combined.

In the above-described embodiments, fatty acid metal salt is interposed between the tip portion T of the cleaning member 362 and the photoreceptor body 31 and then the cleaning performance of the cleaning member 362 is improved. It is considered that the cleaning performance of the cleaning member 362 is improved by the same operation even if fatty acid metal salt is interposed between the tip portion T of the cleaning member 362 for cleaning the image carrying body other than the photoreceptor body 31 and the image carrying body. For example, fatty acid metal salt may be applied to one of the tip portion of the belt cleaner 49 and the intermediate transfer body 41 so as to interpose fatty acid metal salt between the tip portion of the belt cleaner 49 that is the plate-shaped cleaning member and the intermediate transfer body 41. In this case, fatty acid metal salt is applied to the tip portion of the belt cleaner 49 or applied from one end to the other end of the intermediate transfer body 41 in the axial direction of the rotation shaft (the belt transport roll 43 or the backup roll 44) to revolve the intermediate transfer body 41.

The image forming unit of the exemplary embodiments of the invention may be a device including at least the photoreceptor body 31 and the cleaning member 362. In addition, the cleaning device 36 is unitized and may be detachably mounted on the image forming apparatus 1.

The image forming apparatus 1 of the exemplary embodiments of the invention may not be the apparatus that forms the image of 4 colors and may be an apparatus that forms an image of 3 colors or less or 5 colors or more. In addition, the image forming apparatus 1 of the exemplary embodiments of the invention may also be a rotary type image forming apparatus and the like other than the tandem type. In addition, the image forming apparatus 1 of the exemplary embodiments of the invention may transfer the toner image from the photoreceptor body 31 to the medium such as the sheet P by direct transfer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming unit comprising:

an image carrying body that is configured to be rotatable and that carries an image formed on a surface thereof with a toner;

a plate-shaped cleaning member that includes a support member, and a tip portion which is pressed against the surface and which scrapes a material adhering onto the surface in response to rotation of the image carrying body;

a powder of a fatty acid metal salt that is applied to at least one of the tip portion and the surface; and a developing unit that develops a latent image formed on the surface with a developer that contains toner and does not contain the fatty acid metal salt.

2. The image forming unit according to claim 1, wherein the fatty acid metal salt is applied to spread from one end of the tip portion in an axial direction of a rotation shaft of the image carrying body to the other end of the tip portion.

3. The image forming unit according to claim 1, wherein the fatty acid metal salt is applied to spread from one end of the surface in an axial direction of a rotation shaft of the image carrying body to the other end of the surface.

4. The image forming unit according to claim 1, wherein the fatty acid metal salt includes zinc stearate.

5. The image forming unit according to claim 1, wherein:

the plate-shaped cleaning member is configured to be deformed by being pulled in a tangential direction of a surface of a photoreceptor body and a wedge-shaped space is formed between the plate-shaped cleaning member and the surface of the photoreceptor body; and after the space is formed, the plate-shaped cleaning member maintains the deformed shape.

6. An image forming apparatus comprising:

an image carrying body that is configured to be rotatable and that carries an image formed on a surface thereof with a toner;

a charging unit that charges the surface;

a latent image forming unit that forms a latent image on the charged surface;

a developing unit that develops the latent image formed on the surface to a toner image with a developer containing toner;

a transfer unit that transfers the toner image formed on the surface to a medium;

a plate-shaped cleaning member that includes a support member, and a tip portion which is pressed against the surface and which scrapes a material adhering onto the surface in response to rotation of the image carrying body;

a powder of a fatty acid metal salt that is applied to at least one of the tip portion and the surface; and a developing unit that develops a latent image formed on the surface with a developer that contains toner and does not contain the fatty acid metal salt.

7. The image forming apparatus according to claim 6, wherein a lubricant supply unit that supplies lubricant containing the fatty acid metal salt to the surface is not used.

8. The image forming apparatus according to claim 6, wherein the fatty acid metal salt includes zinc stearate.

9. The image forming apparatus according to claim 6, wherein:

the plate-shaped cleaning member is configured to be deformed by being pulled in a tangential direction of a surface of a photoreceptor body and a wedge-shaped space is formed between the plate-shaped cleaning member and the surface of the photoreceptor body; and after the space is formed, the plate-shaped cleaning member maintains the deformed shape.

10. A cleaning device comprising:

a plate-shaped cleaning member that includes a support member, and a tip portion which is pressed against a surface of an image carrying body that carries an image formed on the surface thereof with a toner, the tip portion which scrapes a material adhering onto the surface in response to rotation of the image carrying body; and a powder of a fatty acid metal salt that is applied to the tip portion.

11. The cleaning device according to claim 10, wherein the fatty acid metal salt includes zinc stearate.

12. The cleaning device according to claim 10, wherein:

the plate-shaped cleaning member is configured to be deformed by being pulled in a tangential direction of a surface of a photoreceptor body and a wedge-shaped space is formed between the plate-shaped cleaning member and the surface of the photoreceptor body; and after the space is formed, the plate-shaped cleaning member maintains the deformed shape.

* * * * *